United States Patent [19]

Ulery

[11] Patent Number: 4,772,225

[45] Date of Patent: Sep. 20, 1988

[54] ELECTRICAL TERMINAL HAVING MEANS FOR MOUNTING ELECTRICAL CIRCUIT COMPONENTS IN SERIES THEREON AND CONNECTOR FOR SAME

[75] Inventor: Kirk D. Ulery, Mount Joy, Pa.

[73] Assignee: AMP Inc, Harrisburg, Pa.

[21] Appl. No.: 122,961

[22] Filed: Nov. 19, 1987

[51] Int. Cl.[4] ..... H01R 13/66

[52] U.S. Cl. ..... 439/620; 333/182; 29/854

[58] Field of Search ..... 439/620, 621, 622; 333/181–185; 361/430, 431; 29/854–856

[56] References Cited

U.S. PATENT DOCUMENTS

| | | | |
|---|---|---|---|
| 2,462,934 | 3/1949 | Athey | 439/621 |
| 4,376,922 | 3/1983 | Muzslay | 333/183 |
| 4,443,050 | 4/1984 | Taylor | 439/622 |
| 4,582,385 | 4/1986 | Couper et al. | 439/620 |
| 4,689,597 | 8/1987 | Galloway et al. | 337/186 |
| 4,699,445 | 10/1987 | Porta et al. | 439/620 |

*Primary Examiner*—Gil Weidenfeld
*Assistant Examiner*—Gary F. Paumen
*Attorney, Agent, or Firm*—Katherine A. Nelson

[57] ABSTRACT

An electrical terminal having electrical circuit components mounted in series thereon comprises a body section having terminal sections extending outwardly from each end, the terminal sections being adapted to be electrically connected to complementary conductive means of other respective electrical articles. The body section includes at least one component-receiving portion having a first section and a second section initially integrally joined by a severable section. A dielectric housing means is secured to the body section, the housing means having a component-receiving aperture therein associated with each of the component-receiving portions, the first and second and severable sections initially being exposed along a bottom surface of the aperture. The housing means is adapted to permit severing of the several section, thus electrically disconnecting the associated first and second sections. An electrical circuit component having respective first and second contact means can be joined in series along the circuit path to corresponding first and second sections of the component-receiving sections thus permitting means for altering an electrical signal as it passes through the terminal. A method for making the electrical terminal is also disclosed. An electrical connector having a plurality of such terminals and filtering means therein is also disclosed.

20 Claims, 9 Drawing Sheets

It is a further object of the invention to provide a means, which is readily automatable, for altering an electrical signal.

Furthermore, it is an object of the invention to provide a cost effective means for providing wave shaping capabilities for a connector within a standardized packaging system.

Additionally, it is an object of the invention to provide means for altering electrical signals while eliminating the problems associated with leaded electrical circuit components, particularly the increased impedance owing to the length of the leads.

It is further an object of the invention to provide an electrical connector having means for altering an electrical signal as it passes through the terminals therein and means for providing filtering capabilities.

Some of the objects and advantages of the invention having been stated, others will appear as the description proceeds when taken in conjunction with the accompanying drawings.

BRIEF DESCRIPTION OF THE DRAWINGS

FIG. 5 is a top plan view of a strip of stamped terminal blanks.

FIG. 6 is a perspective view of a portion of the strip of FIG. 5 after the terminal sections have been formed.

FIG. 7 is a perspective view of a plurality of terminal members removed from the strip with the broken lines illustrating the severable sections.

FIG. 8 is a perspective view of the formation of the housing over the terminals of FIG. 7 with the severable sections exploded from one member thereof.

FIG. 9 is a top plan view of FIG. 8.

FIG. 10 is a cross-sectional view of two strips of terminals taken along the line 10—10 of FIG. 9, illustrating the internesting of the terminal strips to provide a row of terminals having the desired centerline.

DETAILED DESCRIPTION OF THE DRAWINGS

Figure 1:
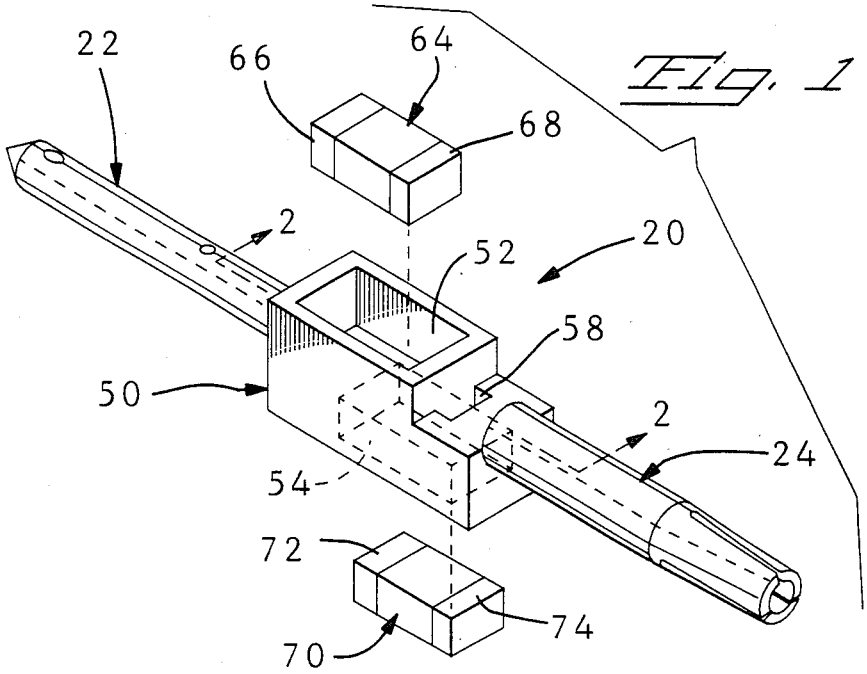
FIG. 1 is a perspective view of an electrical terminal made in accordance with the invention with the electrical components exploded therefrom.
Figure 2:
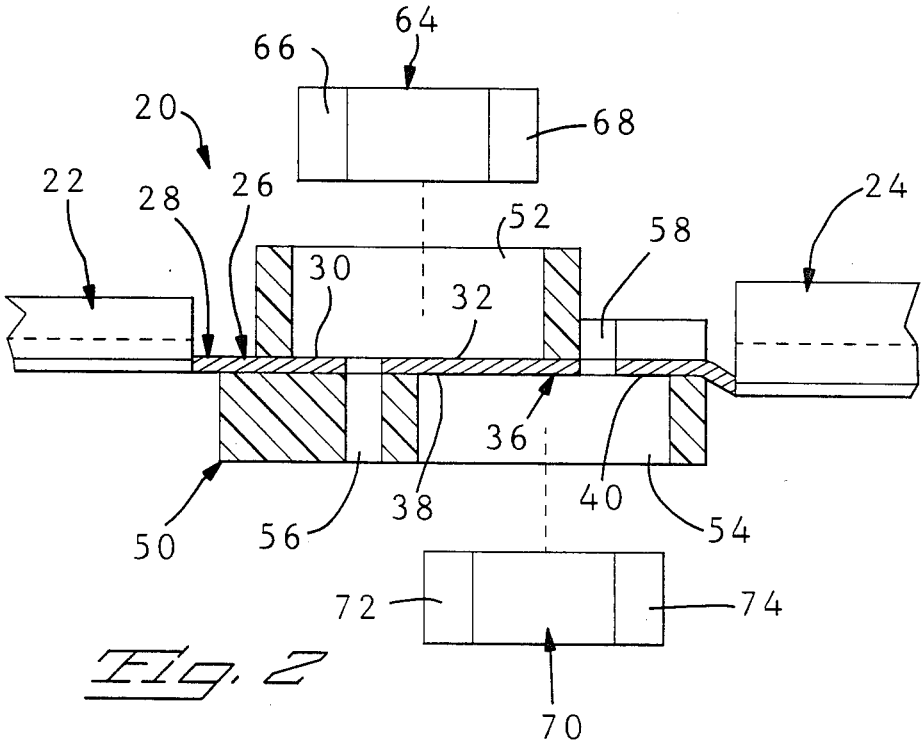
FIG. 2 is an enlarged partially cross-sectional view of the terminal taken along line 2—2 of FIG. 1.

FIGS. 1 and 2 illustrate the preferred embodiment of terminal 20 made in accordance with the invention. Terminal 20 is comprised of first and second terminal sections 22, 24 which extend outwardly from respective ends of intermediate body section 26. Terminal sections 22, 24 are adapted to be electrically connected to complementary conductive means of other respective electrical articles. In the embodiment shown, first terminal section 22 is a pin terminal and second terminal section 24 is a socket. It is to be understood that terminal pins and sockets are used herein in the broad sense to denote any type of contact which can extend through a connector and can be electrically connected to complementary conductive means of other articles.

Figure 7:
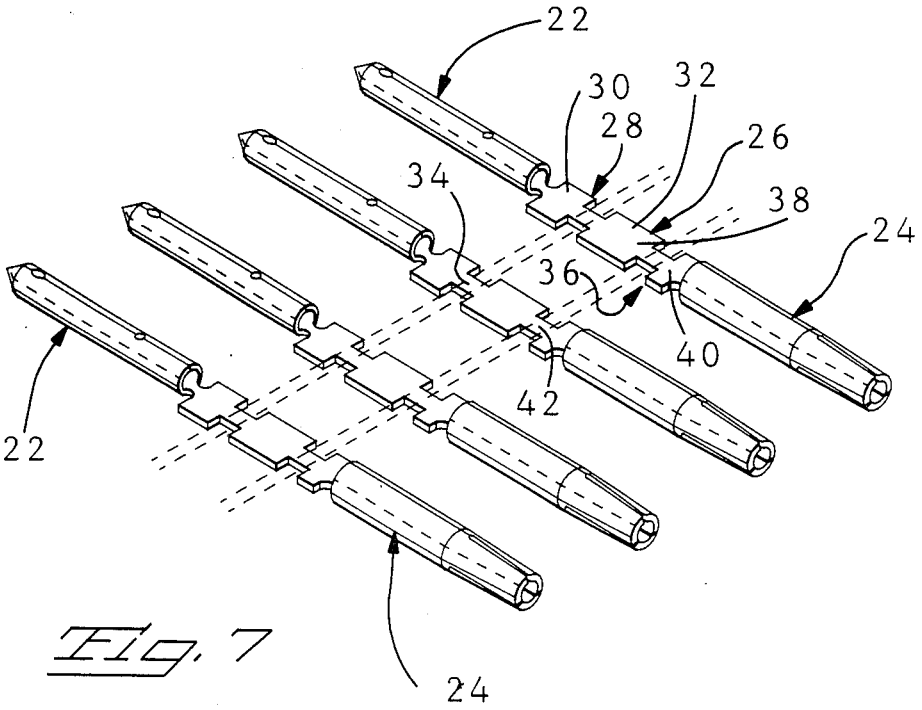

In the preferred embodiment, body section 26 has two component-receiving portions 28 and 36 extending therealong, each component-receiving portions 28, 36 having respective first sections 30, 38 and second sections 32, 40 initially integrally joined by respective severable sections 34, 42, as best seen in FIG. 7. As is further seen in FIG. 7, second section 38 of first component-receiving portion 28 is integrally joined to the first section 38 of second component-receiving portion 36 to allow electrical circuit components to be mounted in series with the signal passing through terminal 20.

Referring again to FIGS. 1 and 2, body section 26 further has dielectric housing means 50 secured thereto. Housing means 50 has two component-receiving apertures 52, 54 associated therewith, aperture 52 being aligned with first component-receiving portion 28 and aperture 54 being aligned with second component-receiving section 36 and with their respective severable sections 34, 42. In the embodiment shown, component-receiving apertures 52, 54 are formed in housing means 50 on opposite sides of terminal 20. Dielectric housing means 50 further includes first and second apertures 56 and 58 overlying respective severable sections 34, 42 of body section 26 to permit removal of severable sections 34 and 42.

First and second electrical components 64 and 70 are mounted in respective component-receiving apertures 52 and 54. Each of the components includes first contact means 66, 72 and second contact means 68, 70 respectively, which are electrically engaged to respective first component-receiving sections 30, 38, and second component-receiving sections 32, 40. Components 64, 70 are preferably surface-mounted components. Various components such as inductors, resistors, capacitors, fuses, diodes, and the like, may be mounted in the component-receiving apertures.

Figure 5:
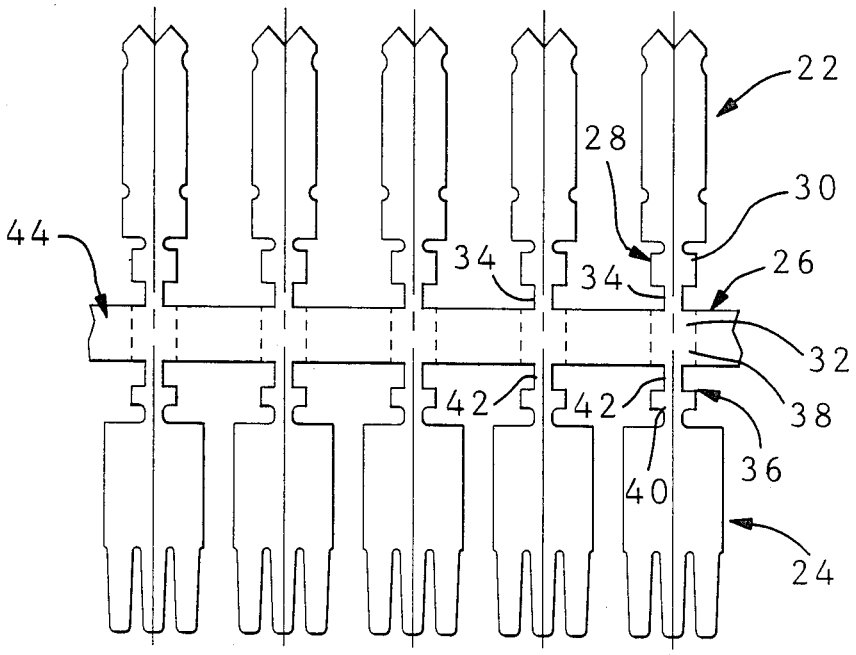
FIGS. 5 through 10 illustrate the method of assembling the electrical terminal members of FIG. 1.

FIGS. 5 through 8 illustrate the construction of electrical terminal of FIGS. 1 and 2. A strip of metal is first stamped, as shown in FIG. 5, to form carrier strip 44 having the blanks for first and second terminal sections 22, 24 and body sections 26 extending outwardly therealong. It is to be understood that the configuration of the first and second terminal section blanks will be different from that shown in FIG. 5 for other terminal constructions. Owing to the amount of material necessary for forming the pin and socket terminal sections of FIG. 6, the metal strip is stamped so that formed terminal sections 22, 24 will have twice the centerline spacing as required in a finished connector assembly, such as the connector shown in FIGS. 3 and 4. Two strips of formed terminal members, such as those shown in

ELECTRICAL TERMINAL HAVING MEANS FOR MOUNTING ELECTRICAL CIRCUIT COMPONENTS IN SERIES THEREON AND CONNECTOR FOR SAME

FIELD OF THE INVENTION

The present invention relates generally to electrical connectors, and more particularly to electrical connectors having terminals therein which carry electrical circuit components.

BACKGROUND OF THE INVENTION

There is an increasing need to protect electronic equipment against radiated and conducted electromagnetic interference. While shielding is the main means for protecting against radiated EMI, some equipment requires extensive and complex filtered circuits combined with shielding to meet standards required by industry and/or various government agencies. There is an increasing need, therefore, for means to limit the frequency content of information signals to prevent radiation and thereby reduce the need for elaborate shielding. This basic concept is known as "wave shaping" and it is accomplished by filtering a signal such that the shape of the fundamental signal is noticeably altered. By slowing down the rise time, the high frequency content of a signal is greatly reduced, which results in less radiation. The wave shaping is achieved by providing capacitance, inductance, and/or resistance, or combinations thereof, in series with the signal. Currently, wave shaping capability is provided by mounting respective leaded components on a printed circuit board and attaching the printed circuit board to a connector. This method results in a relatively large package for the wave shaping device.

It is desirable to have a means for accomplishing wave shaping that may be packaged inside the connector rather than external to the connector. It is also desirable to have a means for integrating one or more active or passive electrical components in series along the circuit path of an individual electrical terminal, which may then be included in a connector package. Furthermore, it is desirable to eliminate problems generally associated with leaded components. In addition it is desirable to have a more cost effective method for achieving wave shaping.

SUMMARY OF THE INVENTION

The present invention is directed to an electrical terminal having means for mounting one or more electrical circuit components in series thereon. The terminal comprises a body section having first and second terminal sections extending outwardly from each end thereof, the terminal sections being adapted to be electrically connected to complementary conductive means of other respective electrical articles. The body section of the terminal has at least one electrical circuit component-receiving portion extending therealong, each said component-receiving portion having a first section and a second section initially integrally joined by a severable section. A dielectric housing means is secured to the body section of the terminal. The housing means has an electrical circuit component-receiving aperture therein associated with each of the at least one electrical circuit component-receiving portions of the terminal body. The first and second and severable sections are exposed along a bottom surface of the at least one aperture. The housing means is adapted to permit severing of each of the severable sections whereby each of the severable sections can be severed to electrically disconnect the associated first and second sections. Respective contact means of an electrical circuit component can then be joined to the first and second sections to achieve an electrical terminal having at least one component joined in series along the circuit path of the terminal, thus permitting means for altering an electrical signal as it passes through the terminal.

In the presently preferred embodiment, the body section includes two component-receiving portions having respective first and second sections initially integrally joined by a severable section and the second section of the first component-receiving portion being integrally joined to the first section of the second component-receiving portion. The dielectric housing means, in the preferred embodiment, includes two electrical circuit component-receiving apertures each being in alignment with respective component-receiving portions. Upon severing each of the respective severable sections, the contact means of two respective components may be joined in series along the circuit path of the terminal.

The present invention is further directed to a method for making the above terminal comprising the steps of forming a metal member into a body section having terminal sections extending outwardly from each end thereof, said terminal sections being adapted to being electrically connected to complementary conductive means of other respective electrical articles, said body section having at least one component-receiving portion extending therealong, each said component-receiving portion having a first section and a second section initially integrally joined by a severable section; and forming a dielectric housing means secured to said body section said housing means having a component-receiving aperture therein associated with each said at least one component-receiving portion, said first and second and severable sections being exposed along a bottom surface of said at least one aperture, said housing means being adapted to permit severing of each said severable section; whereby each said severable section can be severed electrically disconnecting the associated first and second sections and respective contact means of a component can be joined to said first and second sections to achieve an electrical terminal having at least one said component joined in series along the circuit path of said terminal permitting means for altering an electrical signal as it passes through said terminal.

The present invention is further directed to an electrical connector which includes a plurality of terminals made in accordance with the invention. The electrical connector further includes filtering means in parallel with the terminals to provide a connector having filter means for altering an electrical signal as it passes through said terminal and for filtering undesired electromagnetic radiation.

It is an object of the present invention to provide a means for allowing electrical circuit components to be mounted in series in an electrical terminal member.

It is a further object of the invention to provide a means for altering signals through a terminal in a compact packaging manner.

In addition, it is an object of the invention to provide a cost effective manufacturing process.

Figure 4:
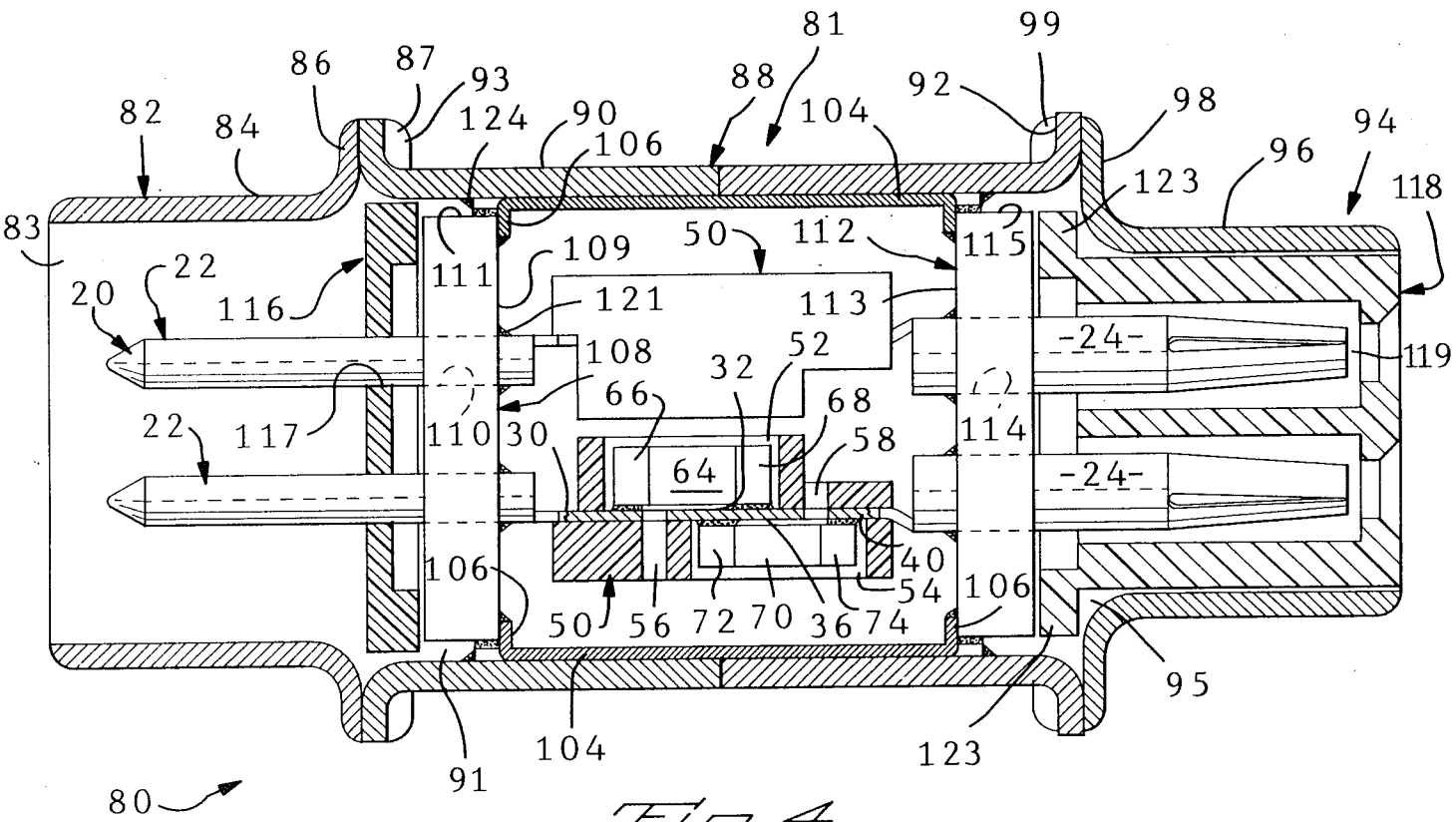
FIG. 4 is a cross-sectional view of the connector of FIG. 3.
Figure 6:
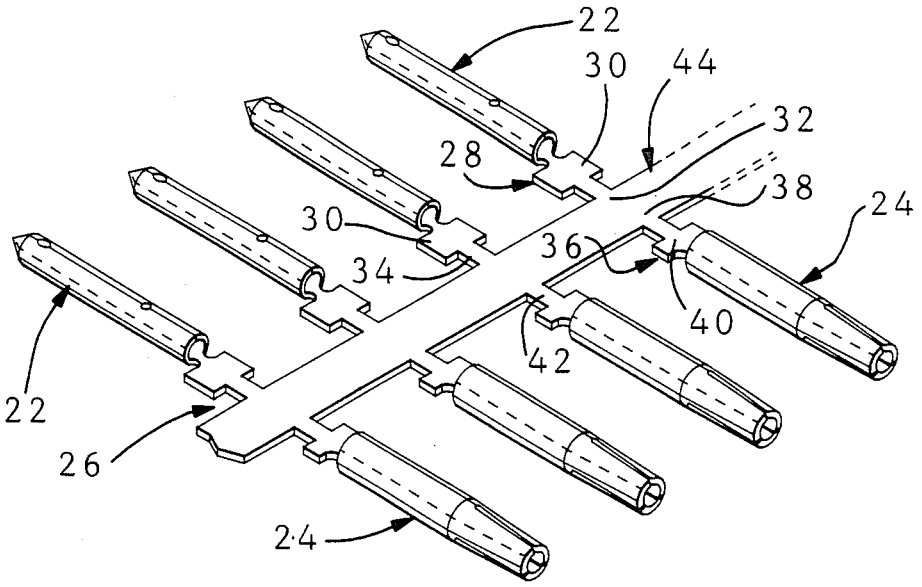
Figure 8:
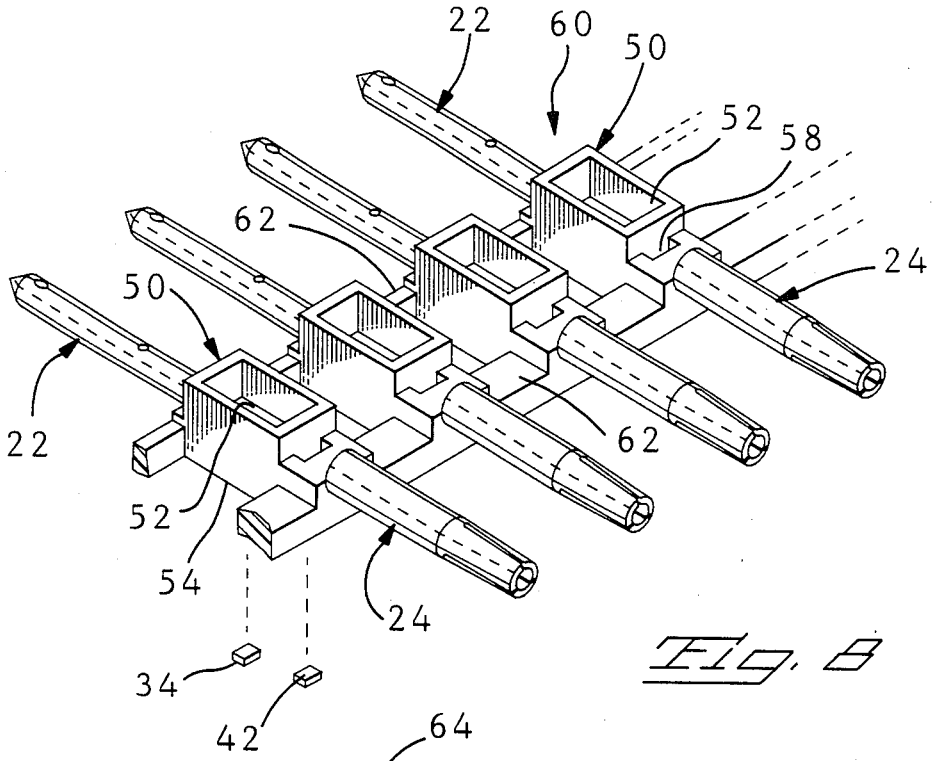

FIGS. 4 or 8, can then be superimposed upon each other to provide terminal sections with the desired centerline spacing. In the embodiment illustrated, carrier strip 44 forms part of body section 26 when individual terminal members are severed form carrier strip 44. FIG. 7 shows a plurality of terminal members severed from carrier strip 44. The broken lines indicate the locations of severable sections 34 and 42.

Figure 8A:
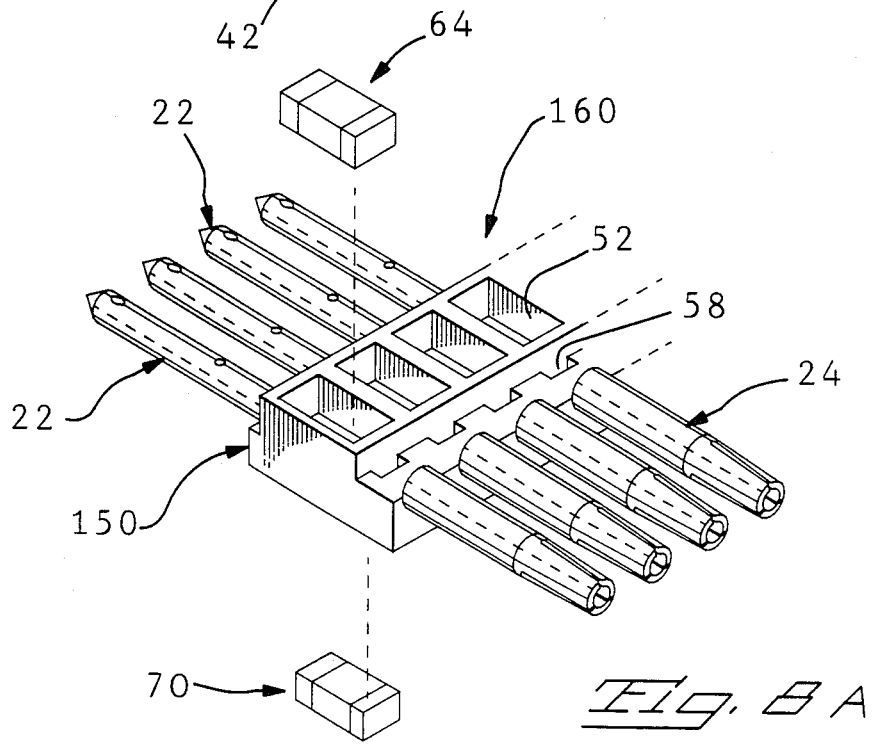
FIG. 8A is a perspective view of an alternative method for forming the housing means over a plurality of terminals.
Figure 9:
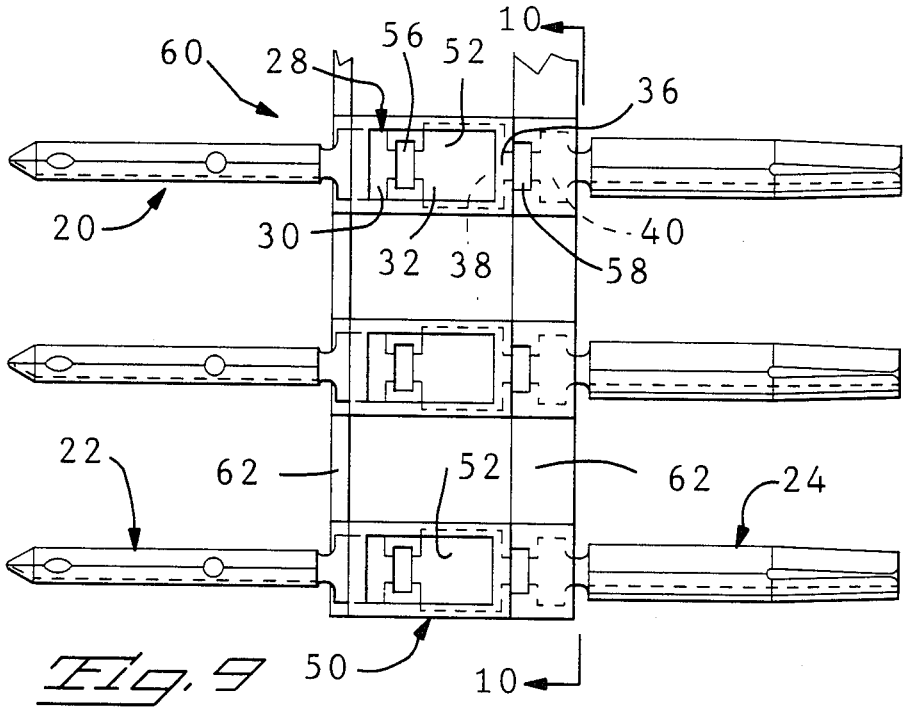
Figure 10:
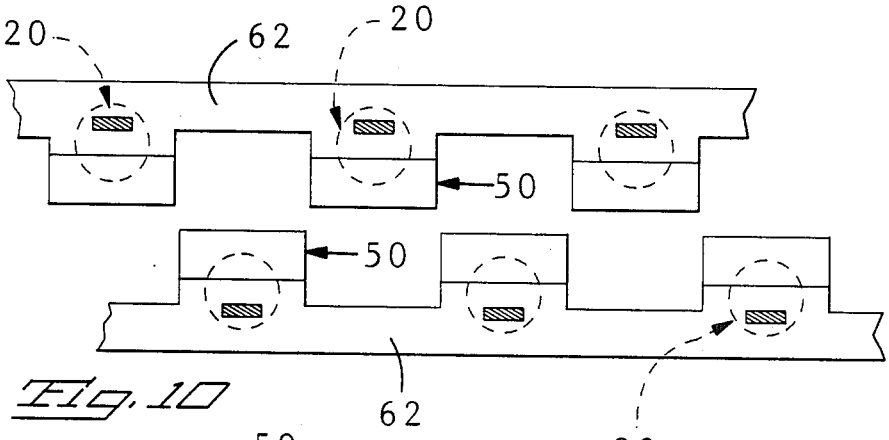
Figure 10A:
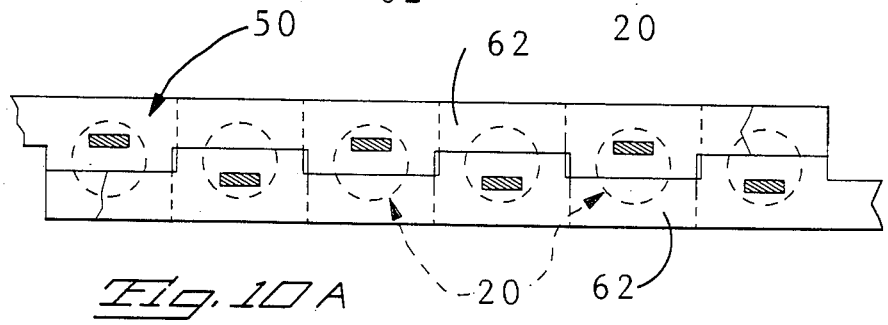
FIG. 10A is a view similar to that of view 10 illustrating the internested rows of terminals.

FIGS. 8 and 8A illustrate alternative methods for molding respective dielectric housing means 50, 150 on the terminals to form an intermediate articles 60, 160 respectively. FIG. 8 illustrates one method of forming housing means 50. The formed terminals are placed in the mold such that the centerline spacing of adjacent terminal sections is twice that of the desired centerline spacing of the connector in which the terminal members 20 are to be used. Housing means 50 is disposed around each terminal such that respective component-receiving apertures 52, 54 overly their respective component-receiving sections 28, 36 as best seen in FIG. 9. Each housing means 50 is spaced from its immediately adjacent housing means 50. Adjacent housing means 50 are integrally joined to dielectric carrier strips 62, which hold the terminal sections in the desired configuration. This method of forming housing means 50 enables two strips 62, 62 of terminal members 20 to be superimposed upon one another and the housing means 50 on one strip 62 to be internested between the housing means 50 for adjacent terminal members 20 of the second strip 62, thus providing terminal sections having the correct centerline spacing, as best seen in FIGS. 10 and 10A.

FIG. 8A shows an alternative method in which the terminals are placed in the mold with the centerline spacing required by the connector in which terminals 20 are to be used. Housing means 150 is molded around the terminals in a continuous strip with respective component-receiving apertures 52, 54 overlying their respective component-receiving sections 28, 36.

After the housing means 50 has been molded, severable sections 34, 42 are removed or punched from body section 26 as shown in FIG. 8, thus providing mechanical and electrical discontinuity between respective first and second component-receiving sections 30, 32 and 38, 40, as best seen in FIG. 9. Components 64 and 70 are then mounted into the cavities as shown in FIGS. 1, 2 and 8A.

Figure 11:
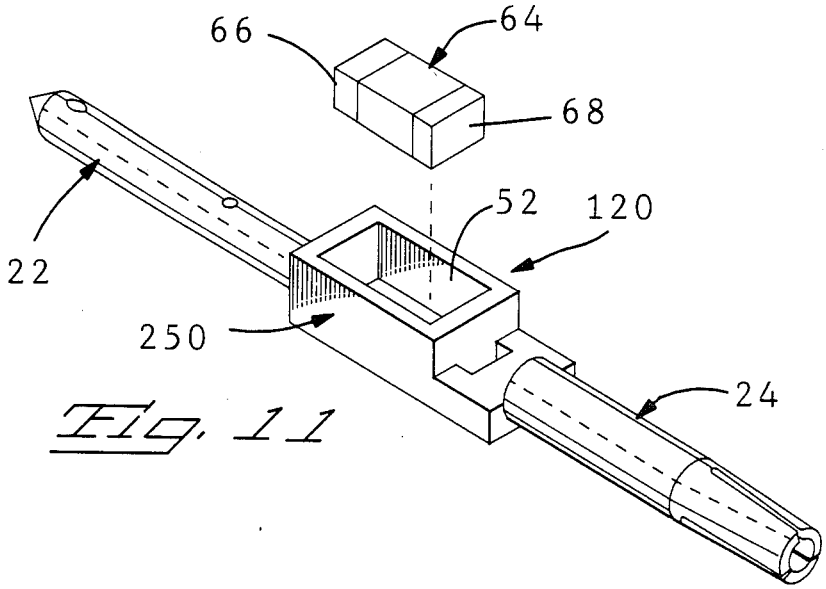
FIG. 11 is a perspective view of an alternative embodiment of the electrical terminal wherein the housing means has a single component-receiving cavity.
Figure 11A:
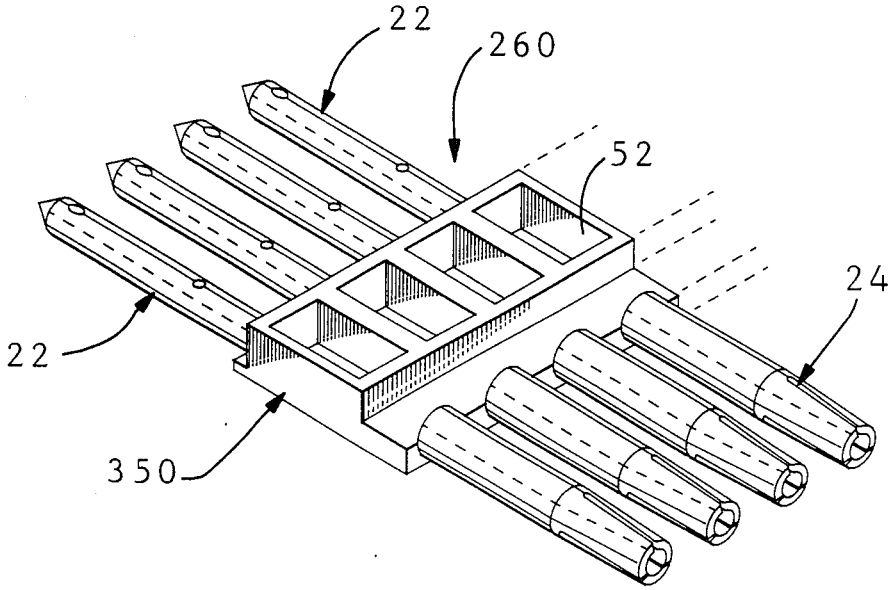
FIG. 11A is a perspective view of a strip of electrical terminal members having the housing means of FIG. 11.

FIG. 11 shows an alternative embodiment 120 of a terminal member having housing means 250 disposed thereon. Housing means 250 has a single component-receiving cavity 52. FIG. 11A shows a strip 260 of housing means 350 disposed onto a plurality of terminal members 120, each terminal member 120 having a single component-receiving cavity 52 associated therewith.

Figure 3:
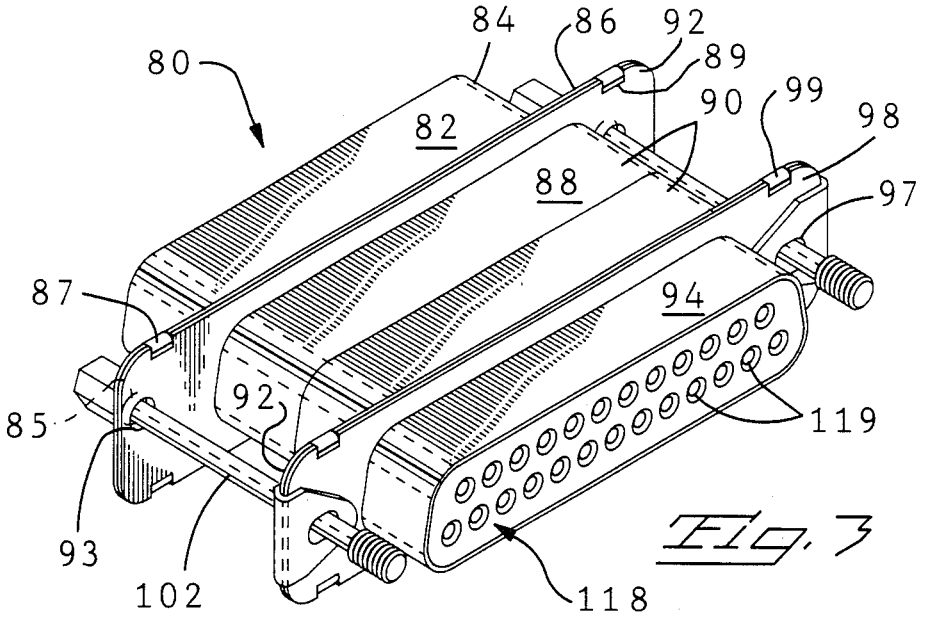
FIG. 3 is a perspective view of an electrical connector having therein electrical terminals made in accordance with the present invention.

FIGS. 3 and 4 disclose a connector 80 made in accordance with the present invention. This particular embodiment is known in the art as an adaptor and often is used to provide filtering means for unfiltered equipment or to increase the filtering capability of a filtered system. In accordance with the present invention, the adaptor is provided with wave shaping as well as filtering capabilities. The adaptor is readily inserted into a system by unplugging existing connector members and mating them with respective sides of the adaptor. In the embodiment shown, the adaptor is provided with oppositely directed configurations suitable for intermating with plug and receptacle members. The adaptor is useful for retrofitting existing electrical connectors of known configurations to provide wave shaping and other filtering capabilities. It is to be understood that the connector of FIGS. 3 and 4 is representative of the types of connectors that can be made in accordance with this invention.

Connector 80 is comprised of an outer conductive shell member 81 having a passageway extending therethrough, a plurality of terminal members 20 extending axially along the passageway and first and second substrate members 108, 112 extending laterally across the passageway. Each terminal member 20 include means thereon for mounting one or more electrical circuit components in series along its circuit path. Substrate members 108, 112 include apertures 110 and 114 through which terminal members 20 extend. In the preferred embodiment, the electrical components provide wave shaping capabilities for connector 80. Preferably connector 80 also includes means for filtering signals.

Conductive shell 81 includes a first end portion 82, an intermediate portion 88, and a second end portion 94, having passageway portions 83, 91, and 95 respectively extending therethrough. First and second end shell portions 82, 94 are profiled to accommodate respective terminal sections 22, 24 disposed therein. In the embodiment shown, first end portion 82 is comprised of an outwardly extending wall 84, which surrounds passageway 83, and an upward extending flange 86 around the periphery of wall 84. As can be seen in FIG. 3, flange 86 includes clinching tines 87 at selected locations around its periphery for securing first end portion to intermediate shell portion 88. Flange 86 also includes a mounting portion including aperture 85 extending therethrough for receiving mounting bolt 102. Second end portion 94 is comprised of an outwardly extending wall 96, which surrounds passageway 95, and an upward extending flange 98 around the periphery of wall 96. Flange 98 includes clinching tines 99 at selected locations around its periphery for securing second end portion 94 to intermediate shell portion 88 in the same manner as flange 86. Flange 98 also includes a mounting portion having aperture 97 extending therethrough for receiving mounting bolt 102.

In the embodiment illustrated, intermediate portion 88 includes wall 90 having a substantially rectangular center portion with outwardly directed flanges 92 extending around the entire front and rear peripheries. For ease of manufacturing, intermediate portion 88 is preferably formed from two essentially identical parts, which are secured together. It may, however, be formed as a single unit. Flanges 92 include notches 89 which cooperate with corresponding clinching tines 87, 99 on end shell portions 82, 94 respectively. Flanges 92 include apertures 97 for receiving mounting bolt 102. Portions of shell 81 are assembled by securing respective flanges 86, 98 of end portions 82, 94 onto respective flanges 92 on opposite ends of the intermediate portion 88 by engaging clinching tines 87, 99 of end portions 82, 94 in corresponding notches 89 of intermediate portion 88. Bolts 102 extend through respective apertures 97, 93 and 85 mating flange portions to secure the adaptor to a ground plane. It is to be understood that other means may be used to secure the shell members together and to mount connector 80 at its desired location.

First and second substrate members 108, 112 are disposed laterally in passageway 91 and have apertures 110 and 114 extending therethrough in which are disposed terminal sections 22, 24 respectively. Substrate members 108, 112 provide support for terminal sections 22, 24 and maintain them in the configuration required for engagement with a complementary connector. Substrate members 108, 112 are secured in a spaced relationship by spacer means shown in connector 80 as spacer plates 104, which extend along the top and bottom inner surfaces of intermediate shell portion 88. Depending upon the physical configuration of a connector the spacer means may be a one piece plate, tubular or box member or comprised of two or more members. Spacer plates 104 have upstanding fingers 106 thereon for engagement with internal surfaces 109, 111 of substrate members 108, 112 respectively. Substrate members 108, 112 may be passive or active substrates. When terminal members 20, having components mounted in series therealong are used in combination with at least one active substrate member, filtering as well as wave shaping capabilities can be provided for an electrical connector.

In the preferred embodiment, first and second substrate members 108, 112 are planar capacitors having conductive surfaces along outer edges 111, 115 respectively for electrical connection to ground, shown as 124. Planar capacitors are known in the art and are commercially available. Other active substrate members include planar resistive members and transient suppression substrates, such as those disclosed in U.S. patent application Ser. No. 06/758,712, filed July 26, 1985, now U.S. Pat. No. 4,729,752. Terminal sections 22 and 24 are electrically connected at 121, preferably by solder or conductive adhesive to conductors on respective substrate members 108, 112.

FIGS. 14 and 15 illustrate schematic circuits that are possible when various components are inserted into the component-receiving apertures of the present invention. These components include resistors, inductors, capacitors, diodes, fuses, and the like. They may be used in various combinations depending upon the amount of filtering or wave shaping desired for the particular terminal.

Figure 14A:
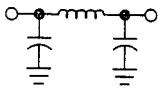
FIGS. 14A through 14H and 15A through 15D are schematic diagrams of representative circuits achievable by means of the present invention.
Figure 14B:
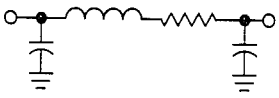
Figure 14C:
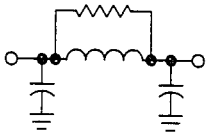
Figure 14D:
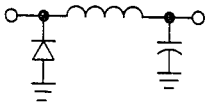
Figure 14E:
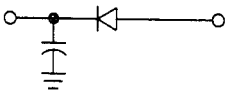
Figure 14F:
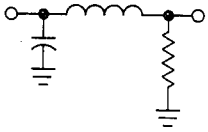
Figure 14G:
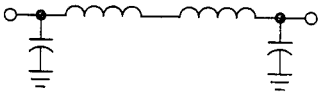
Figure 14H:
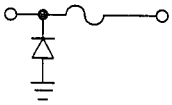
Figure 15A:
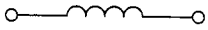
Figure 15B:
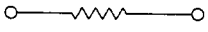
Figure 15C:
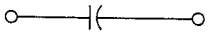
Figure 15D:
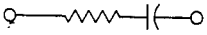

FIG. 14A illustrates a typical pi-filter construction having two capacitive substrates and having an inductor in series and two capacitive substrates in parallel. FIG. 14B shows the two capacitive substrates in parallel and an inductor and resistor in series, forming what is known in the art as a tuning circuit. FIG. 14C again shows the two capacitive substrates in parallel and a resistor and inductor in series. FIG. 14D shows a substrate having blocking diodes and a capacitive substrate, forming an L-style filter with a diode. FIG. 14E illustrates a capacitive substrate in parallel and a blocking diode in series. FIG. 14F shows a capacitor and resistor in parallel and an inductor in series to form a simulated termination-style connector. FIG. 14G illustrates a second pi-filter construction having two capacitive substrates in parallel and two inductors in series, thus providing greater inductance for the terminal. FIG. 14H illustrates a connector having a diode in parallel and a fuse in series, thus protecting premise wiring from large fault currents caused by diode or internal equipment failures.

FIG. 15 shows electrical schematics for connectors having passive substrate members and various components mounted in the component-receiving apertures. FIGS. 15A through 15C show respectively, an inductor, a resistor, and a blocking capacitor. FIG. 15D shows a resistor and capacitor in series to form what is known as an RC tuning circuit. As can be seen from the various diagrams of FIGS. 14 and 15, it is also possible to vary the components in individual terminals within the same connector.

FIG. 4 also shows insulator member 116 having apertures 117 therein for receiving terminal portion 22 and insert means 118 having apertures 119 therein for receiving terminal portions 24. Insulator member 116 and insert means 118 are retained in position in connector 80 by appropriately configured end shell portions 82, and 94.

Figure 12:
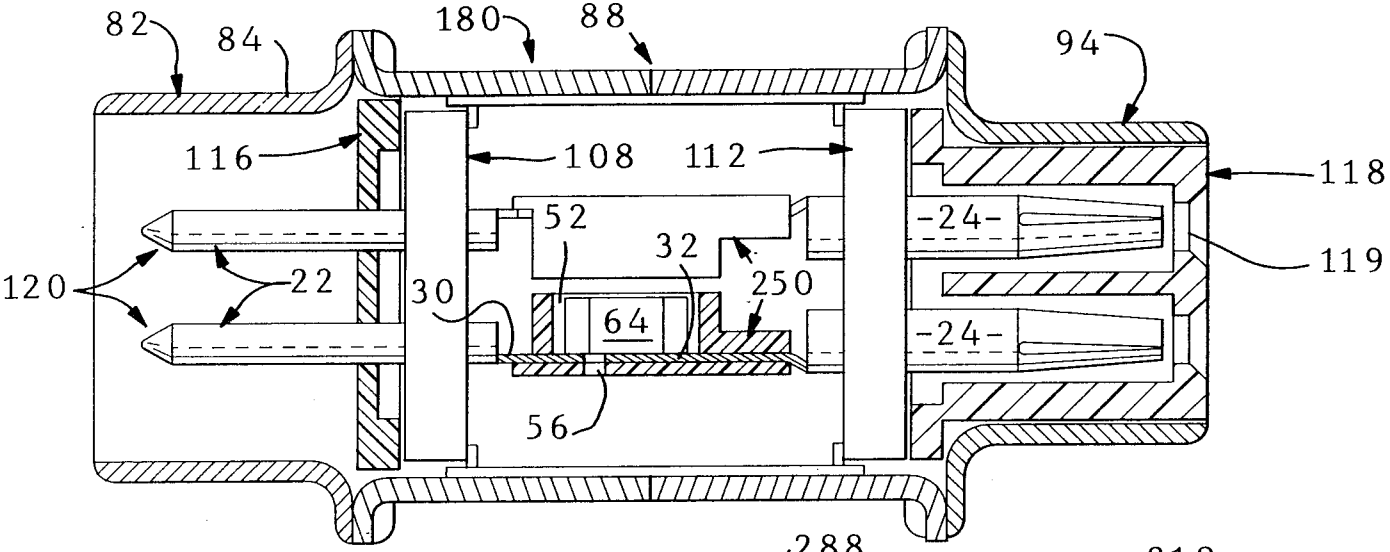
FIG. 12 is a perspective view of an alternative embodiment of the connector of FIG. 3 having the terminals of FIG. 11.
Figure 13:
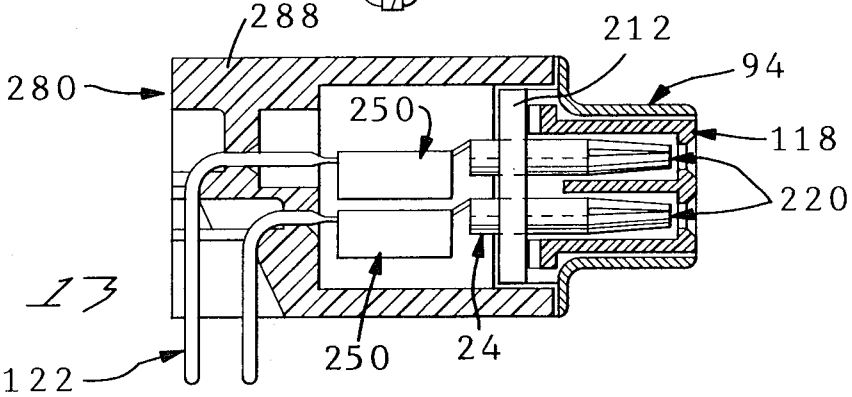
FIG. 13 is a perspective view of a further alternative embodiment of a connector having electrical terminals made in accordance with the present invention.

FIG. 12 is a cross-section of a connector 180, similar to connector 80 shown in FIGS. 3 and 4, but having the electrical terminal members 120 of FIG. 11. FIG. 13 is an alternative embodiment 280 of a connector having dielectric housing means 288, end shell portion 94 and terminal members 220. In this embodiment, first terminal sections 122 are right-angle mounting pins for a printed circuit board (not shown) and second terminal sections 24 are socket members. Since housing member 288 provides support for first terminal sections 122, only second terminal sections 24 need to be supported by a substrate member, 212. Substrate 212 may be active or passive, depending upon the electrical requirements of the connector.

In assembling connector 80, as shown in FIGS. 3 and 4, a subassembly is formed comprising a plurality of terminals 20, first and second substrate members 108, 112 and spacer plates 104. First and second terminal sections 22, 24 are inserted into corresponding apertures 110, 114 in respective substrate mebers 108, 112. When the substrate members are active, such as planar capacitive elements as in the preferred embodiment, terminal sections 22, 24 are thereby elecrically connected to corresponding conductors on their respective substrate members 108, 112. Substrate members 108 and 112 are then brought into alignment against fingers 106 of spacer plates 104 and secured thereto. Spacer plates 104 are also secured to and electrically engaged with respective ground conductors 111, 115 on the ends of capacitive substrates 108, 112. To ensure electrical engagement between terminal sections 22, 24 and the corresponding conductors on substrates 108, 112 respectively, terminal sections 22, 24 are preferably secured in place by solder or conductive epoxy.

The subassembly is then placed inside intermediate shell member 88 and spacer plates 104 are electrically connected and preferably secured to the outer shell members with solder or conductive epoxy. To complete the assembly of connector 80, dielectric insulator member 116 is disposed over the first terminal sections and dielectric insert means 118 is disposed over second terminal portions 24 members. Appropriately profiled first and second end shell members 82, 94 are then assembled in place and secured to intermediate shell member 88 by means of clinching tines 87, 99 in flanges 86, 98 and notches 89 in flanges 92. It is to be understood that other means may be used to secure the shell members together. Cavities 83 and 95 in first and second end shell members 82, 94 are suitably profiled to retain insulator member 116 and insert means 118 in connector 80, as can best be seen in FIG. 4.

The present invention provides a means for accomplishing wave shaping that may be packaged inside an electrical connector package in a cost effective manner. The invention is directed to an electrical terminal member that carries means thereon for mounting one or more active or passive electrical components in series along its circuit path.

In the drawings and specification there has been set forth preferred embodiments of the invention, and although specific terms are employed, they are used in a generic and descriptive sense only, and not for purposes of limitation.

What is claimed is:

1. An article to become an electrical terminal comprising:

a body section having terminal sections extending outwardly from each end thereof, said terminal sections being adapted to being electrically connected to complementary conductive means of other respective electrical articles;

said body section has at least one component-receiving portion extending therealong, each said component-receiving portion having a first section and a second section initially integrally joined by a severable section; and dielectric housing means secured to said body section, said housing means having at least one component-receiving aperture therein associated with each said at least one component-receiving portion, said first and second and severable sections being exposed along a bottom surface of each said at least one aperture, said housing means being adapted to permit severing of each said severable section; whereby each said severable section can be severed, electrically disconnecting the associated first and second sections, and respective contact means of at least one component can be joined to said first and second sections to achieve an electrical terminal having at least one said component joined in series along the circuit path of said terminal, thus providing means for altering an electrical signal as it passes through said terminal.

2. The article as described in claim 1 wherein said body section includes two component-receiving portions, having respective first and second sections initially integrally joined by a said severable section, the second section of the first component-receiving portion being integrally joined to the first section of the second component-receiving portion, and said dielectric housing means includes two component-receiving apertures, whereby upon severing each said severable section, respective contact means of two said components may be joined in series along the circuit path of said terminal.

3. The article as described in claim 1 wherein said at least one component is selected from the group comprising inductors, capacitors, resistors, diodes, fuses and combinations thereof.

4. The article as described in claim 2 wherein said at least one component is selected from the group comprising inductors, capacitors, resistors, diodes, fuses, and combinations thereof.

5. An electrical terminal comprising: a body section having terminal sections extending outwardly from each end thereof, said terminal sections being adapted to being electrically connected to complementary conductive means of other respective electrical articles;

said body section has at least one component-receiving portion extending therealong, each said component-receiving portion having a first section and a second section initially integrally joined by a severable section;

dielectric housing means secured, to said body section, said housing means having at least one component-receiving aperture therein associated with each said at least one component-receiving portion, said first and second and severable sections initially being exposed along a bottom surface of each said at least one aperture, said housing means being adapted to permit severing of each said severable section;

said severable section of each of said at least one component-receiving portion has been severed from said first and second sections and electrically disconnected from the associated first and second sections; and at least one electrical circuit component having respective first and second contact means joined to corresponding said first and second sections of each of said at least one component-receiving sections, whereby each said at least one electrical component is joined in series along the circuit path of said terminal thus, thus providing means for altering an electrical signal as it passes through said terminal.

6. The electrical terminal as described in claim 5 wherein said body section includes two component-receiving portions, having respective first and second sections initially integrally joined by a said severable section, the second section of the first component-receiving portion being integrally joined to the first section of the second component-receiving portion, and said dielectric housing means includes two component-receiving apertures, whereby upon severing each said severable section, respective contact means of two said components may be joined in series along the circuit path of said terminal.

7. The electrical terminal as described in claim 5 wherein said at least one component is selected from the group comprising inductors, capacitors, resistors, diodes, fuses and combinations thereof.

8. The electrical terminal as described in claim 6 wherein said at least one component is selected from the group comprising inductors, capacitors, resistors, diodes, fuses, and combinations thereof.

9. An electrical connector having disposed therein at least one electrical terminal as described in claim 5.

10. An electrical connector comprising:

a shell means having a passageway extending therethrough;

at least one electrical terminal disposed in said passageway, said terminal comprising a body section having terminal sections extending outwardly from each end thereof, said terminal sections being adapted to being electrically connected to complementary conductive means of other respective electrical articles, said body section has at least one component-receiving portion extending therealong, each said component-receiving portion having a first section and a second section initially integrally joined by a severable section; dielectric housing means secured to said body section, said housing means having at least one component-receiving aperture therein associated with each said at least one component-receiving portion, said first and second and severable sections initially being exposed along a bottom surface of each said at least one aperture, said housing means being adapted to permit severing of each said severable section; said severable section of each of said at least one component-receiving portion being severed from said first and second sections and electrically disconnected from the associated first and second sections; and at least one electrical circuit component having respective first and second contact means joined to corresponding said first and second sections of each of said at least one component-receiving sections, each said component being joined thereby in series along the circuit path of said terminal; and at least one planar substrate means disposed in said passageway, said substrate means having at least one aperture extending therethrough for receiving each of said at least one electrical terminal member therein; whereby each said electrical component, which is joined in series along the circuit path of each of said at least one terminal, provides means for altering an electrical signal as it passes through said at least one terminal in said connector.

11. The electrical connector as described in claim 10 wherein said body section includes two component-receiving portions, having respective first and second sections initially integrally joined by a said severable section, the second section of the first component-receiving portion being integrally joined to the first section of the second component-receiving portion, and said dielectric housing means includes two component-receiving apertures, whereby upon severing each said severable section, respective contact means of two said components may be joined in series along the circuit path of said terminal.

12. The electrical connector as described in claim 10 wherein said at least one component is selected from the group comprising inductors, capacitors, resistors, diodes, fuses and combinations thereof.

13. The electrical connector as described in claim 11 wherein said at least one component is selected from the group comprising inductors, capacitors, resistors, diodes, fuses, and combinations thereof.

14. The electrical connector as described in claim 13 wherein said at least one substrate member is active.

15. The electrical connector as described in claim 14 wherein said at least one substrate member is selected from the group comprising capacitive, resistive and transient suppression substrates.

16. The electrical connector as described in claim 10 further including filtering means.

17. A method for making an article to become an electrical terminal comprising the steps of:

forming a metal member into a body section having terminal sections extending outwardly from each end thereof, said terminal sections being adapted to being electrically connected to complementary conductive means of other respective electrical articles, said body section having at least one component-receiving portion extending therealong, each said component-receiving portion having a first section and a second section initially integrally joined by a severable section; and forming a dielectric housing means secured to said body section, said housing means having at least one component-receiving aperture therein associated with each said at least one component-receiving portion, said first and second and severable sections being exposed along a bottom surface of each said at least one aperture, said housing means being adapted to permit severing of each said severable section; whereby each said severable section can be severed, electrically disconnecting the associated first and second sections, and respective contact means of at least one component can be joined to said first and second sections to achieve an electrical terminal having at least one said component joined in series along the circuit path of said terminal, thus providing means for altering an electrical signal as it passes through said terminal.

18. A method for making an electrical terminal member having electrical circuit components mounted in series thereon comprising the steps of:

forming a metal member into a body section having terminal sections extending outwardly from each end thereof, said terminal sections being adapted to being electrically connected to complementary conductive means of other respective electrical articles, said body section having at least one component-receiving portion extending therealong, each said component-receiving portion having a first section and a second section initially integrally joined by a severable section;

forming a dielectric housing means secured to said body section, said housing means having at least one component-receiving aperture therein associated with each said at least one component-receiving portion, said first and second and severable sections being exposed along a bottom surface of each said at least one aperture, said housing means being adapted to permit severing of each said severable section;

severing each said severable section, thus electrically disconnecting the associated first and second sections; and joining respective contact means of at least one electrical circuit component to respective said first and second sections to achieve an electrical terminal having at least one said component joined in series along the circuit path of said terminal, thus providing means for altering an electrical signal as it passes through said terminal.

19. The method for making an electrical terminal member as described in claim 18 wherein said at least one component is selected from the group comprising inductors, capacitors, resistors, diodes, fuses and combinations thereof.

20. The method for making an electrical terminal member as described in claim 19 wherein said body section includes two component-receiving portions, having respective first and second sections initially integrally joined by a said severable section, the second section of the first component-receiving portion being integrally joined to the first section of the second component-receiving portion, and said dielectric housing means includes two component-receiving apertures, whereby upon severing each said severable section, respective contact means of two said components may be joined in series along the circuit path of said terminal.

* * * * *